US010174567B2

(12) United States Patent
Wase

(10) Patent No.: US 10,174,567 B2
(45) Date of Patent: Jan. 8, 2019

(54) HANDLING DEVICE FOR DRILL STRING COMPONENT IN RESPECT OF A ROCK DRILL RIG AND ROCK DRILL RIG

(71) Applicant: EPIROC ROCK DRILLS AKTIEBOLAG, Örebro (SE)

(72) Inventor: Lars Wase, Danderyd (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 125 days.

(21) Appl. No.: 14/897,050

(22) PCT Filed: Jun. 26, 2014

(86) PCT No.: PCT/SE2014/000091
§ 371 (c)(1),
(2) Date: Dec. 9, 2015

(87) PCT Pub. No.: WO2015/016756
PCT Pub. Date: Feb. 5, 2015

(65) Prior Publication Data

US 2016/0115746 A1 Apr. 28, 2016

(30) Foreign Application Priority Data

Aug. 2, 2013 (SE) ..... 1350925

(51) Int. Cl.
*E21B 19/15* (2006.01)

(52) U.S. Cl.
CPC ..... *E21B 19/15* (2013.01); *E21B 19/155* (2013.01)

(58) Field of Classification Search
CPC ..... E21B 19/15; E21B 19/155; E21B 19/20
See application file for complete search history.

(56) References Cited

U.S. PATENT DOCUMENTS 3,254,776 A * 6/1966 Brown ..... B65G 1/08 193/17
6,189,620 B1 2/2001 McDowell
(Continued)

FOREIGN PATENT DOCUMENTS

CL 2015003676 A1 7/2016
CL 2015003677 A1 7/2016
(Continued)

OTHER PUBLICATIONS

PCT/ISA/210—International Search Report—dated Nov. 11, 2014 (Issued in Application No. PCT/SE2014/000091).
(Continued)

*Primary Examiner* — James G Sayre
(74) *Attorney, Agent, or Firm* — Venable LLP; Jeffri A. Kaminski

(57) ABSTRACT

A handing device for handling drill string components in a rock drill rig. The handing device includes a magazine for storing drill string components to be introduced into and removed from a drill string position of the drill rig. The magazine includes, in the region of a loading position, a transfer unit for separation of a drill string component being positioned on a support from an adjacent drill string component and to transfer the separated drill string component to the loading position. The transfer unit includes a plurality of pivot arms being pivotal around a pivot axis, being parallel to the axial direction, from a first position. The pivot arms lie against a drill string component being closest to the loading position on the support, to a second position. The pivot arms allow bringing down the separated drill string component to the loading position. Also a rock drill rig.

12 Claims, 4 Drawing Sheets

(56) References Cited

U.S. PATENT DOCUMENTS

| | | | | |
|---|---|---|---|---|
| 6,634,443 | B1 | 10/2003 | Paech et al. | |
| 2005/0161227 | A1 | 7/2005 | Hayes et al. | |
| 2008/0101891 | A1* | 5/2008 | Belik | E21B 19/15 414/22.57 |
| 2011/0091304 | A1* | 4/2011 | Tetley | E21B 19/15 414/22.62 |
| 2016/0130890 | A1 | 5/2016 | Wase | |
| 2016/0130891 | A1 | 5/2016 | Wase | |

FOREIGN PATENT DOCUMENTS

| | | | |
|---|---|---|---|
| EP | 1916379 | A1 | 4/2008 |
| GB | 2047306 | A | 11/1980 |
| GB | 2334270 | A | 8/1999 |
| WO | WO-2013/176618 | A1 | 11/2013 |

OTHER PUBLICATIONS

PCT/ISA/237—Written Opinion of the International Searching Authority—dated Nov. 11, 2014 (Issued in Application No. PCT/SE2014/000091).

Chilean Office Action dated Jun. 27, 2018 issued in corresponding Chilean Application No. 2015-003600 (11 pages).

* cited by examiner

HANDLING DEVICE FOR DRILL STRING COMPONENT IN RESPECT OF A ROCK DRILL RIG AND ROCK DRILL RIG

CROSS-REFERENCE TO RELATED APPLICATIONS

The application claims priority to Swedish patent application 1350925-2 filed 2 Aug. 2013 and is the national phase under 35 U.S.C. § 371 of PCT/SE2014/000091 filed 26 Jun. 2014.

FIELD OF THE INVENTION

The invention concerns a handling device for handling drill string components in a rock drill rig. The handing device includes a magazine for storing drill string components to be introduced into and be removed from a drill string position of the drill rig. The magazine includes support means for support of a plurality of drill string components that are capable of rolling, said support means being inclinable for inclination towards and from a loading position, from which separate drill string components are intended to be transferred to said drill string position. The invention also relates to a rock drill rig equipped with such a handling device.

BACKGROUND OF THE INVENTION

Core drilling for exploration purposes is usually performed with rock drill rigs, wherein the drill string components are placed in the active drill string position, lifted up from and lowered down into the drill hole with a winch. The winch wire is fastened to the uppermost drill string component with the aid of a lifting plug. Since core drilling aims to remove a drilled-out core of rock to be examined, tubular drill string components are used. During lifting of the drill string, which is performed frequently for exchange of drill bits, the string of tubes is lifted unit by unit, whereby the separate tubes are released from each other with the aid of the rotator device of the drill rig in co-operation with a lower tube holder.

Final release of a tube to be brought away from the drill string is today at least partly performed manually by the operators, this handling including final threading-off and lifting and guiding of the tube to an area of a tube magazine.

During lowering of the drill string, the working steps are performed reversely such that new drill string components in the form of tubes are successively lifted to a position where they are aligned with the drill string and threaded together by the operator. These working steps are straining for the operator and involve a risk of being subject to lifting and squeezing injuries for the operator which is not negligible.

Core drilling is often performed to very great depths, such as for example to drill length between 1000-2000 m. Because of the drill bit in operation being subject to wear, it has to be replaced relatively often, which results in that the entire drill string has to be lifted up from the drill hole, be dismounted into drill string components, the worn drill bit be removed and be replaced by a new one, whereupon the drill string can again be lowered down into the hole. Thereupon a further distance is drilled until the drill bit has to be replaced again etc. During the drilling, a flushing liquid swivel is connected to the uppermost end of the drill string for supplying flushing liquid for transporting away rock material having been disintegrated during drilling.

SUMMARY OF THE INVENTION

It is an aim of the invention to provide a device of the above kind, wherein handling of drill string components is at least partly improved. This is achieved in respect of a device according to the above in that the magazine, in the region of the loading position, includes a transfer unit for separation of a drill string component being positioned on said support means from an adjacent drill string component in order to transfer the separated drill string component to the loading position and to transfer a drill string component from the loading position to the magazine respectively, that the transfer unit includes movable stop elements for said separation, that the transfer unit includes a plurality of pivot arms being distributed along an axial direction of a drill string component being in the loading position, for engagement with a drill string component, said pivot arms being pivotal around a pivot axis, being parallel to said axial direction, from a first position, wherein the pivot arms lie against a drill string component being closest to the loading position on said support means, to a second position, wherein the pivot arms allow bringing down the separated drill string component to the loading position.

Hereby is ensured safe and efficient separation of a drill string component to be introduced into the rig as well as secure positioning thereof in the loading position. This loading position is arranged laterally of the support means of the magazine. By the transfer unit being provided with (pivotal) pivot arms, the possibility is obtained of simple manoeuvring and with simple measures a secure construction that can be manufactured with precision.

The provision of stop elements ensures efficient separation and prevents that drill string components that are still to maintain lying on the support means by mistake move to the region of the loading position during the phase where the drill string is removed as well as when it is introduced into the drill hole.

The inventive transfer unit is also arranged to transfer a drill string component from the loading position to the magazine, whereby the transfer process basically is operated in reverse direction.

It is preferred that each pivot arm is connected to a set of stop elements, which gives the possibility of simple manoeuvring. In particular it is preferred that each set of stop elements is pivotally connected to and supported by a respective pivot arm for limited relative movement around an axis being parallel to said pivot axis.

It is further preferred that the movement of the respective set of stop elements is adjustable for adaption to drill string components of different diameters, which gives simple adjustment when dimension is changed. In particular it is preferred that the movement of the respective set of stop elements is adjustable in that adjustable guiding protrusions co-operating with stop elements are arranged along the movement path of said stop elements.

It is suitable that each pivot arm has an abutment surface, which is shaped so as to provide a drill string component with an upward movement during the movement of the pivot arm from the second position to the first position. An unrestricted movement in vertical direction is then facilitated.

Preferably the magazine has a support body, whereon said support means are pivotally fastened in the region of the loading position for allowing adjustment of the inclination.

It is also preferred that the support body includes fasteners for the pivot arms in connection with fasteners for support units including the support means, in order to facilitate the design of the construction from a stability point of view.

It is suitable that each support unit in an end region opposite to the loading position is supported by an adjustable support leg for adjustment to i.a. uneven ground.

Suitably each support unit in an end region opposite to the loading position is provided with a force actuator for providing adjustment of the inclination of said support means. A normal position of a support means is preferably to be inclined from the loading position and a activated power means the inclination will be towards the loading position.

The handling device preferably includes a swing arm having means for receiving a drill string component in the loading position and being swingable between the loading position and a delivering position to the rock drill rig. The swing arm of the handling device is arranged to swing a supported drill string component from the loading position for drill string components, which is suitably a horizontal position, to said delivering position, which is usually an inclined position for the supported drill string component, and wherein the drill string component is brought further by for example a gripper unit being associated with the rig. The swing arm is suitably pivotally supported by the magazine which is components saving and allows good stability. The swing arm is situated laterally in respect of the transfer unit and the pivot arms in order to permit its vertical movement without interfering therewith. It is for example possible to design the swing arm with its support elements forming a "chute" in order to support a drill string component with lateral recesses for allowing passage of the pivot arms. Other constructional solutions are of course also possible.

The reverse operation to what is described above is applicable when the drill string components are removed from the drill hole and removed from the rig. Then the drill string components are positioned in the loading position and brought by the pivot arms up on the support means which have been readjusted for inclination from the loading position.

In order to effectively and securely ensure accurate alignment between the gripper unit and the drill string component being supported by the swing arm, a guiding beam is suitably arranged which is arranged to form mechanical stop for the swingable gripper unit being arranged on the rig and for the swing arm in the delivering position. For that purpose the guiding beam is suitably pivotally attachable at its end regions.

The invention also relates to a rock drill rig including a rotator device for rotating and driving a drill string and being supported movable to and fro by a feed beam, and a handling device according to the above.

The invention will now be described in greater detail by way of embodiments and with reference to the annexed drawings.

DESCRIPTION OF EMBODIMENTS

Figure 1:
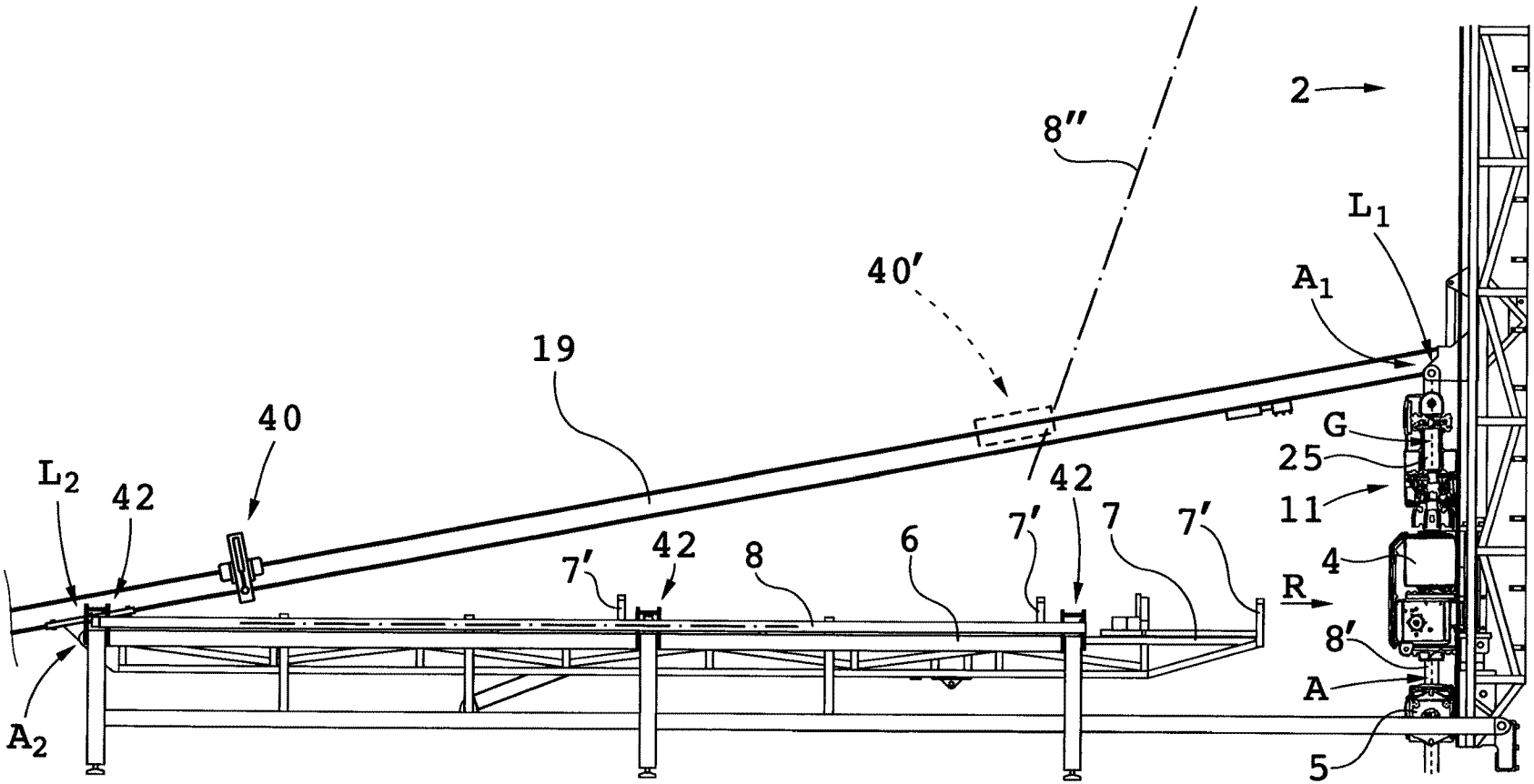
FIG. 1 shows in a side view a rock drill rig for core drilling provided with a handling device according to the invention and in connection with a magazine for drill string components.

FIG. 1 shows a feed beam 2 of a rock drill rig for core drilling being adjustable at different angles. The rig includes a rotator device 4, which is supported on the feed beam 2 for movement to and fro. Below (in the Figure) the rotator device 4 is arranged a tube holder 5 for temporary holding the drill string when this is required.

Beside the feed beam 2 is arranged a (not shown) power and driving aggregate for proving pressure fluid etc to the rock drill rig and a lifting winch (not shown). A magazine 6 is arranged for receiving drill string components (indicated with interrupted line at 8), to be brought into respectively taken out from the rock drill rig in a manner that will be described below.

The magazine 6 shown in FIG. 1 is in the form of a generally horizontal structure, which can be inclined such that drill string components 8 can be brought to roll towards a swing arm 7 for reception of drill string components 8. A transfer unit is effective to transfer a separated drill string component to a loading position which is defined by the spring arm 7. 42 indicates pivot arms being included in the transfer unit. The pivot arms and other components of the magazine will be described in more detail below.

In FIG. 1 is further indicated, with a dot interrupted line at 8", a drill string component in a position during a lifting phase which is a slanting position in respect of the feed beam 2.

This line at 8" in FIG. 1 is intended to illustrate an intermediate position during the lifting phase which is ended by the drill string component assuming a position which is coaxial with an active drill string position of the rock drill 20 rig. Lifting is performed with the aid of a lifting plug (25 see below) being threaded-in uppermost in the drill string component. The lifting plug is during this process in turn connected to a (not shown) lifting wire, which passes over a wire wheel (not shown) uppermost on the feed beam and with its 25 second part extends essentially parallel to the feed beam 2 to the lifting winch (not shown) being arranged in the region of the power and drive aggregate.

Furthermore, FIG. 1 shows a lifting plug 25 being gripped by a gripper unit 11 and being threaded into an end portion of a drill string component 8' being in a drill string position.

FIG. 1 further shows that said end portion is protruding out from the rotator device 4 such that this drill string component 8' is in an active drill string position A. The drill string component 8' has a female thread for engagement with a corresponding male thread on the plug 25.

Joining of a further, second drill string component 8" on the first drill string component 8' for the purpose of extending the drill string for subsequent lowering into the drill hole is essentially corresponding to the method for threading-on of a lifting plug. See below.

The gripper unit 11 is shown in a first position in FIG. 1, in which a gripping position is defined by the gripper unit 11 and having a gripping position axis G (see interrupted line in FIG. 1) which is co-axial with said active drill string position A.

Further in this Figure is shown in greater detail a guiding beam 19, which is arranged to provide a stop for the swing arm 7 in an upwardly swung delivering position of a supported drill string component 8. Furthermore, the guiding beam 19 provides stop for the gripper unit 11 in the second position thereof. Support elements forming a "chute" for supporting a drill string component is indicated with 7'.

The gripper unit 11, is not a subject of this application and is therefore not described in detail here.

After having brought a further drill string component into a position above an existing one in position A (instead of the lifting plug 25 in FIG. 1), the drill string components are drawn together by the rotation means, whereupon the joint as usual is finally tightened by the rotator device 4. Thereupon the drill string can be lowered by slacking the lifting wire. (Joining is of course performed in the same way when the drill string has sunk through drilling.)

Thereupon the drill string is lowered down to the position shown in FIG. 1, whereby the next drill string component has reached the position being indicated with 8' with an end portion protruding out from the rotator device 4 and with the lifting plug 25 being above this drill string component. This lifting plug will now be released from the drill string.

The lifting plug 25 is a swivelling device and therefore has two mutually rotatable parts, namely an engagement portion, which lowermost is provided with a male thread at its free end, which is directed against the drill string component, and a lifting portion, which outermost is provided with a lifting eye for co-operation with a lifting wire as is described above.

When the lifting plug 25 is released from the drill string component 8' (FIG. 1), the gripper unit 11 swings from the first position in the direction of said second position with gripped lifting plug 25 to the second position, where the gripping position is aligned for co-operation with a drill string component 8 supported by the swing arm 7 connected to said magazine. This determined position of the gripper unit 11 is ensured by the guiding beam 19 forming mechanical stop for the swing movement of the gripper unit 11 in this second position.

Here threading-in of the engagement portion into the drill string component 8 is performed and thereupon it is free to be lifted with the aid of the lifting wire such that it will subsequently be in the position of the second drill string component along the "grip position axis" indicated with G in FIG. 1.

Before the drill string component 8 has been lifted, it has been gripped in the second end region, opposite to the end having been threaded together with the lifting plug, by a guiding gripper which is pivotally attached to a gripper shuttle 40 in a joint, the guiding gripper being manoeuvred by a hydraulic cylinder. Thereupon the swing arm 7 is lowered to the loading position (in FIG. 1) where it is out of a movement path of the gripper shuttle 40.

The guiding beam 19 has a longitudinal guide for the drivingly displaceable gripper shuttle. The joint has a joint axis being essentially parallel to the first and second swing axes A1 and A2 for allowing swinging in the same plane as is including the drill string position and the delivering position.

The guiding gripper is arranged, after gripping said drill string component 8, to guide the free end thereof in order to control its movement during the lifting process and in order to guide this free end into alignment with the drill string position A in the rig. With activated guiding gripper gripping a drill string component and running gripper shuttle it is arranged such that the guiding gripper follows in the turning movement without being rotationally controlled in itself.

So far the operative function of the handling device according to the invention has been described for lowering the drill string after for example replacement of a drill bit. Pulling up the drill string is basically operated reversely, that it threading-in of the lifting plug into a drill string component being in the active drill string position, pulling up the lifting plug with connected drill string to a position where the rotator device in a per se known manner is arranged to release the uppermost drill string component from the following drill string component.

Thereupon the drill string is lifted further such that the next drill string component with its end portion finds itself in the position shown in FIG. 1, whereupon the gripper unit 11 comes in and grips the uppermost drill string component and also the next drill string component ("the first") for the purpose of alignment in connection controlled unthreading of the uppermost drill string component.

Thereupon the thus released drill string component is gripped by said guiding gripper and through the movement of the gripper shuttle 40 is brought away from the feed beam 2 out from the position parallel to the active drill string position with its lower end, at the same time as the lifting wire is slacked in a controlled manner such that the drill string component finally reaches the delivering position. Here it and the lift plug can be gripped by the grippers of the gripper unit 11 for unthreading the latter. Lifting of the swing arm 7 for receiving the drill string component now occurs and when unthreading is completed, the swing arm can be lowered for transporting away the supported drill string component to the loading position for transfer to the magazine 6 for storage through the operation of the transfer unit. Thereupon the process can be repeated as many times as necessary.

Figure 2:
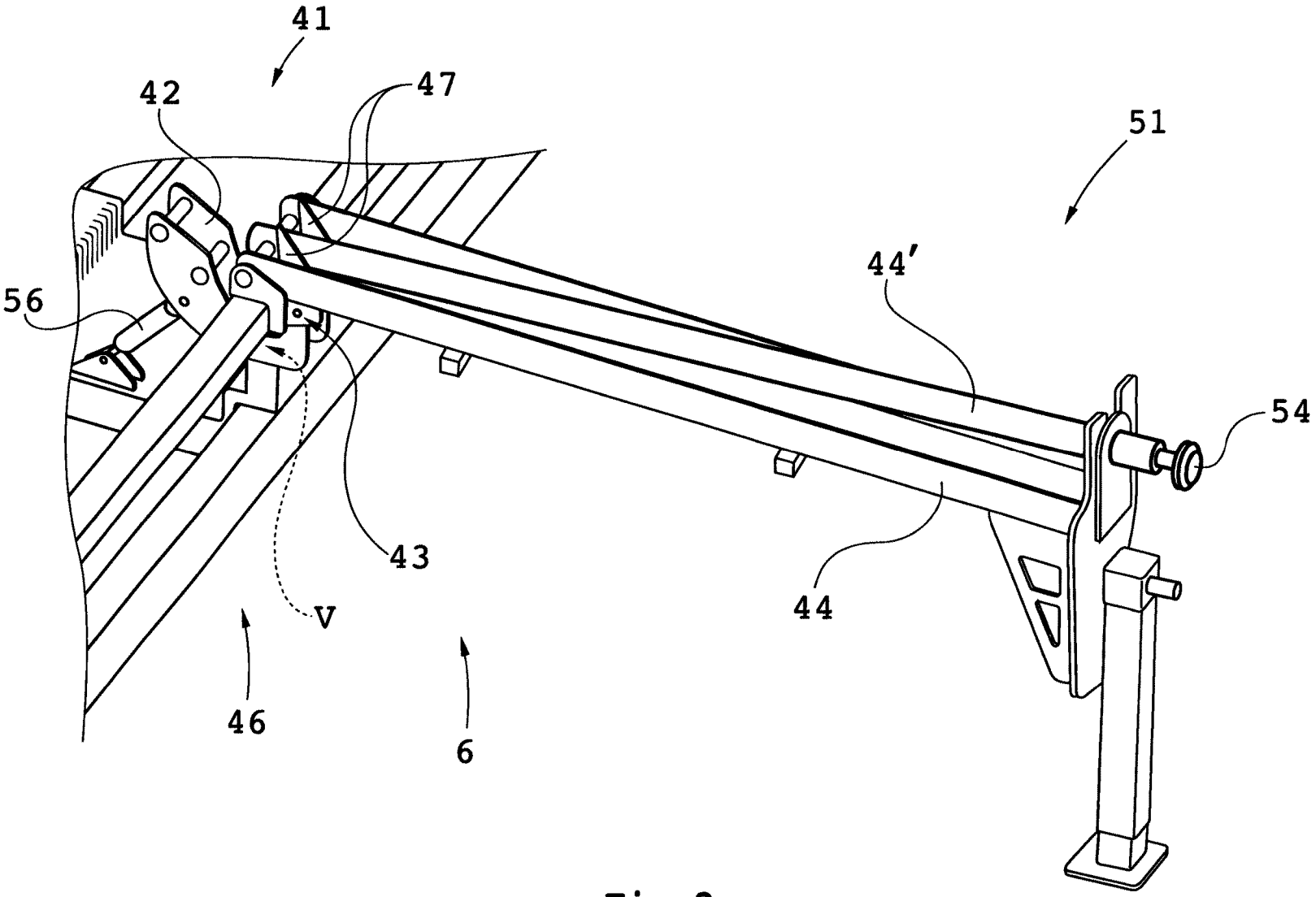
FIG. 2 shows in a perspective view a detail of the magazine according to the invention.

The inventive magazine will now be described in more detail with reference to the FIGS. 2, 3 and 4. As is shown in these Figures, the magazine 6 for storing drill string components 8 to be introduced to or taken out from the drill rig is provided with supports 44 and support means 44' for supporting a plurality of drill string components 8 capable of rolling.

These support means 44' can be inclined for inclination against or from a loading position L, from which the drill string components subsequently can be brought further in order to be transferred to the drill string position.

The magazine includes a transfer unit 41 in the region of the loading position L, said transfer unit being arranged to separate the drill string component being closest to the loading position from adjacent drill string components and to effect transfer of the separated drill string component to the loading position L.

For that purpose the transfer unit is provided with a plurality of pivot arms 42 being distributed along an axial direction R (see FIG. 1) of a drill string component 8 being in the loading position L. These pivot arms are pivotal around a pivot axis V being parallel to said axial direction and are driven by respective hydraulic cylinders 56.

Figure 3:
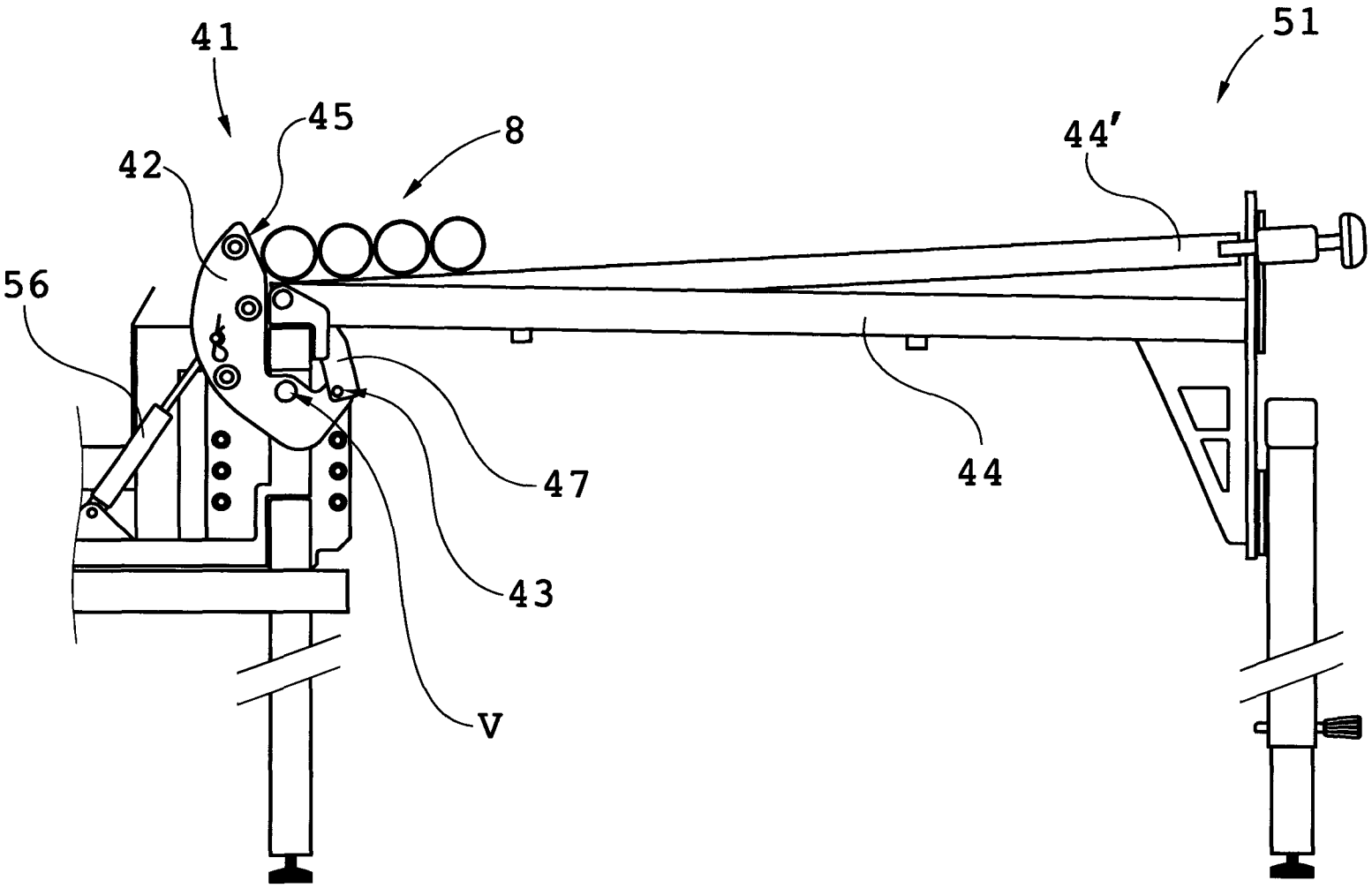
FIGS. 3 and 4 show side views of a detail of the magazine according to the invention in different positions.

The pivot arms are pivotal from a first position being shown in FIG. 3 wherein the pivot arms with a abutment surface 45 lies against a drill string component 8 being closest to the loading position L on said support means 44'. The pivot arms 42 are pivotal from this first position to a second position, which is shown in FIG. 4, and wherein the pivot arms 42 have freed the loading position L and have allowed bringing the separated drill string component 8 down in this loading position L.

The pivot arms 42 are further supporting a set of stop elements 47 in pivotal relationship for limited mutual movement in respect of the respective pivot arm around an axis 43. It can be mentioned that with "set of stop elements" is intended one or more stop elements being associated with the pivot arm. In the shown embodiment the pivot arm is basically comprised of two parallel plates at a distance from each other with distance means between and the number of stop elements 47 is two.

In order to adapt the magazine to drill string components with different diameters (different sizes), that can be handled by the rig, the movement of the respective set of stop elements 47 is adjustable in that adjustable guiding protrusions co-operating with stop elements are arranged along the movement path for the respective stop element. This can in practice be realised such that a guiding protrusion, against which an edge of a stop element abuts, is adjustable for influencing the movement path of the respective stop element. One example of such an adjustable guiding protrusion is indicated with interrupted line at 55 in FIG. 4.

An example of adjustability is through a handle 54 (FIG. 2) which is connected to said guiding protrusion over a rod and through which therefore the guiding protrusion 55 for respective stop element is adjustable in a longitudinal direction S of the support means 44'. The stop element is suitably spring loaded in the direction of the loading position L and controlled so as to resist this spring load.

A support body for the magazine is indicated with 46 and said support means 44' are pivotally arranged thereupon in the region of the loading position L for allowing adjustment of the inclination. The support body 46 includes fasteners 49, 50, on the one hand for the pivot arms 42, on the other hand for support units 51 including a respective rigid support 44, which is inclining from the loading position L as well as the respective support means 44', which is pivotal at the fasteners 50 and adjustable to incline towards the loading position L.

The fasteners 49 and 50 are arranged in connection with each other i.a. for stability reasons and also enhance the manufacture friendliness of the construction.

Each support unit 51 is in an end position opposite to the loading position L supported by an adjustable support leg 52 and at this end region, each support unit is provided with a force actuator 53 in the form of for example a hydraulic cylinder for resetting inclination of said support means 44'. It can be mentioned that the inclination can be adjustable such that a varying inclination can be obtained depending on i.a. the type of drill string component to be handled.

Figure 4:
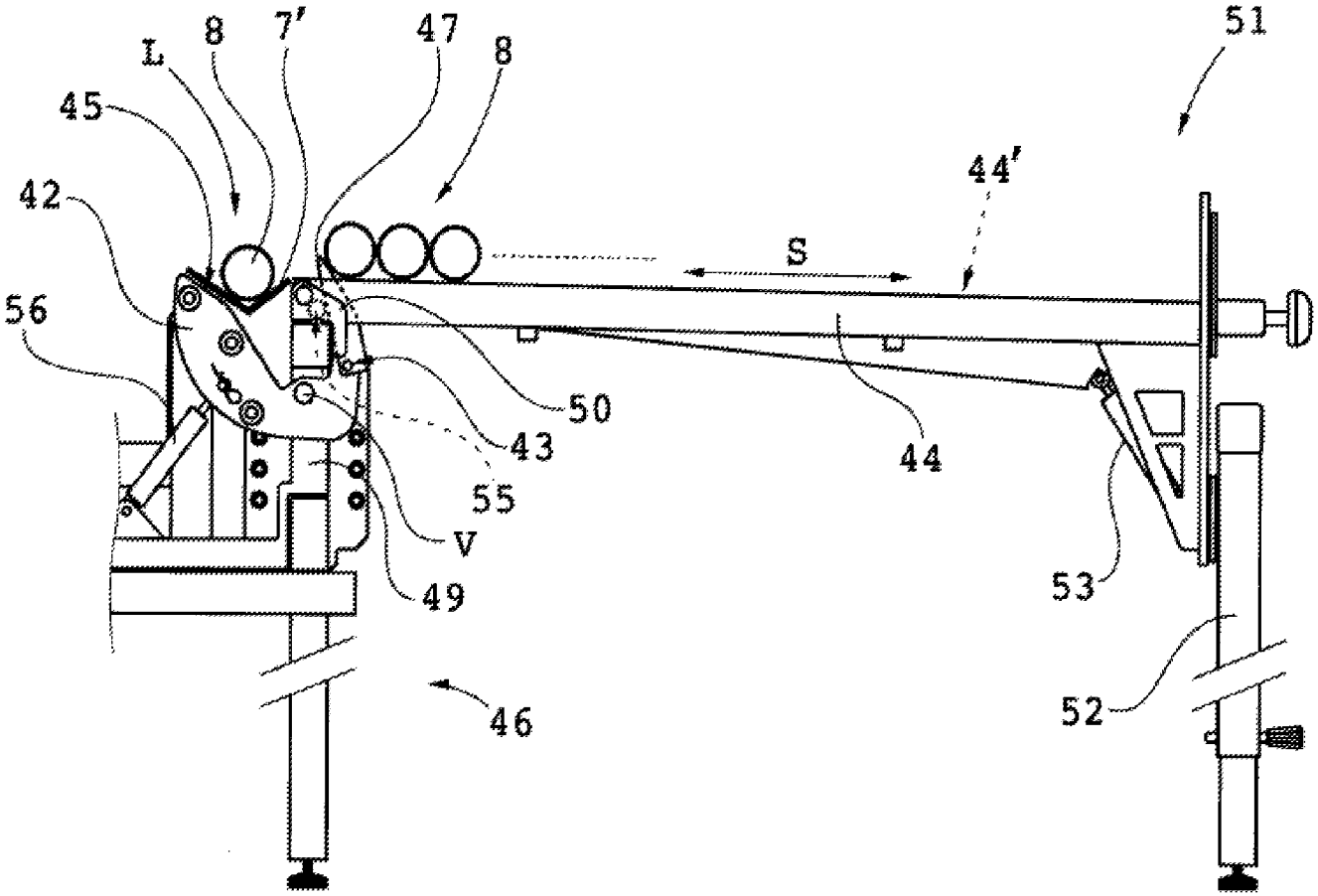

Introducing a drill string component being in the loading position L into the magazine is achieved through the transfer unit from the position shown in FIG. 4 in that the pivot arm is rotated, clockwise as seen in FIG. 4, such that the drill string component 8 is uplifted by the effect of the abutment surface 45 up on the support means 44', which have been inclined so as to be inclining from the loading position.

The invention has been described at the background of a rock drill rig for core drilling but it is adaptable also for other types of rigs such as for oil drilling and the like.

The invention can be modified within the scope of the claims. The magazine can be associated with the rock drill rig in any other way than through a swing arm, which is illustrated above. Drill string components can thus be transferred between the rig and loading position with the aid of other means. The magazine can be adapted to drill string components of different lengths, and as an example a magazine with three pivot arms adapted for drill string components with a lengths of 6 meters can also be used for drill string components with a length of 3 meters, wherein in the latter case only two of the pivot arms are in use.

In its simplest form, the magazine is adapted for manual manoeuvring, wherein an operator decides when different sequences are to be performed adapted to the requirements of the rig. It is, however, not excluded that manoeuvring is automatized with the aid of a computerized control system or the like. This automation then leads to controlled co-operation between the magazine and the rig.

The guiding beam can in a simplified form of the inventive handling device also be placed completely free from the feed beam and the rig. Also in this form it can be possible for the gripper shuttle to fulfil its main purposes:

1) to guide a lower end of a drill string component being lifted by a lifting wire during the process of adding a drill string component to the drill string and finally introduce it to a drill string position,
2) to withdraw a lower end of a drill string component being in a drill string position and being lifted in a lifting wire from the drill string position and lead the lower end during the process of removing a drill string component from the drill string and finally position the drill string component in a magazine or the like.

The invention claimed is:

1. A handling device for handling drill string components in a rock drill rig, which includes a drill string driving device being supported movable by a feed beam for rotation and driving a drill string, the handling device comprising:

a magazine for storing drill string components to be introduced into and removed from a drill string position of the drill rig, wherein the magazine includes a support configured to support a plurality of drill string components that are configured to roll, said support being inclinable for inclination towards and from a loading position, from which separate drill string components are intended to be transferred to said drill string position, wherein the magazine, in the region of the loading position, further includes a transfer unit configured to separate a drill string component being positioned on said support from an adjacent drill string component in order to transfer the separated drill string component to the loading position and to transfer a drill string component from the loading position to the magazine respectively, wherein the transfer unit further includes movable stop elements for said separation, wherein the transfer unit further includes a plurality of pivot arms being distributed along an axial direction of a drill string component being in the loading position, for engagement with a drill string component, said pivot arms being pivotal around a pivot axis, being parallel to said axial direction, from a first position, wherein the pivot arms lie against a drill string component being closest to the loading position on said support, to a second position, wherein the pivot arms allow bringing down the separated drill string component to the loading position, wherein each pivot arm is pivotally connected to a set of the stop elements; and a swing arm configured to receive the drill string component in the loading position and being swingable between the loading position and a delivering position to deliver the received drill string component to the rock drill rig.

2. The handling device according to claim 1, wherein each set of stop elements is pivotally connected to and supported by a respective one of the pivot arms for limited relative movement around an axis being parallel to said pivot axis.

3. The handling device according to claim 2, wherein movement of the respective set of stop elements is adjustable for adaption to drill string components of different diameters.

4. The handling device according to claim 3, wherein the movement of the respective set of stop elements is adjustable in that adjustable guiding protrusions co-operating with stop elements are arranged along the movement path of said stop elements.

5. The handling device according to claim 1, wherein each pivot arm has an abutment surface, which is shaped so as to provide a drill string component with an upward movement during the movement of the pivot arm from the second position to the first position.

6. The handling device according to claim 1, wherein the magazine has a support body, whereon said support is pivotally fastened in the region of the loading position for allowing adjustment of the inclination.

7. The handling device according to claim 6, wherein the support body includes fasteners for the pivot arms in connection with fasteners for support units including the support.

8. The handling device according to claim 7, further comprising:

an adjustable support leg supporting each support unit in an end region opposite to the loading position.

9. The handling device according to claim 7, further comprising:

a force actuator provided at each support unit in an end region opposite to the loading position, wherein the force actuator is configured to adjust the inclination of said support.

10. The handling device according to claim 1, wherein the swing arm is swingably supported by the magazine.

11. The handling device according to claim 1, wherein the swing arm is swingable about an axis perpendicular to the pivot axis.

12. A rock drill rig, comprising:

a rotator device being supported movable; and a feed beam for rotation and driving of a drill string; and a handling device comprising a magazine for storing drill string components to be introduced into and removed from a drill string position of the drill rig, wherein the magazine includes a support configured to support a plurality of drill string components that are configured to roll, said support being inclinable for inclination towards and from a loading position, from which separate drill string components are intended to be transferred to said drill string position, wherein the magazine, in the region of the loading position, further includes a transfer unit configured to separate a drill string component being positioned on said support from an adjacent drill string component in order to transfer the separated drill string component to the loading position and to transfer a drill string component from the loading position to the magazine respectively, wherein the transfer unit further includes movable stop elements for said separation, wherein the transfer unit further includes a plurality of pivot arms being distributed along an axial direction of a drill string component being in the loading position, for engagement with a drill string component, said pivot arms being pivotal around a pivot axis, being parallel to said axial direction, from a first position, wherein the pivot arms lie against a drill string component being closest to the loading position on said support, to a second position, wherein the pivot arms allow bringing down the separated drill string component to the loading position, wherein each pivot arm is pivotally connected to a set of the stop elements; and a swing arm configured to receive the drill string component in the loading position and being swingable between the loading position and a delivering position to deliver the received drill string component to the rock drill rig.

* * * * *